US007682067B2

(12) United States Patent
West et al.

(10) Patent No.: US 7,682,067 B2
(45) **Date of Patent: *Mar. 23, 2010**

(54) MIXING SYSTEMS AND RELATED MIXERS

(75) Inventors: Derik R. West, Logan, UT (US); Whitt F. Woods, North Ogden, UT (US); Jeremy K. Larsen, Providence, UT (US); Nephi D. Jones, Newton, UT (US); Robert V. Oakley, Lafayette, CA (US); Kurt Thomas Kunas, Pleasanton, CA (US); Fauad F. Hasan, Santa Clara, CA (US)

(73) Assignees: HyClone Laboratories, Inc., Logan, UT (US); Baxter International Inc., Deerfield, IL (US); Baxter Healthcare S.A., Zurich (CH)

( * ) Notice: Subject to any disclaimer, the term of this patent is extended or adjusted under 35 U.S.C. 154(b) by 1007 days.

This patent is subject to a terminal disclaimer.

(21) Appl. No.: 11/379,535

(22) Filed: Apr. 20, 2006

(65) Prior Publication Data

US 2006/0280028 A1 Dec. 14, 2006

Related U.S. Application Data

(63) Continuation-in-part of application No. 11/112,834, filed on Apr. 22, 2005, now Pat. No. 7,384,783.

(60) Provisional application No. 60/784,403, filed on Mar. 20, 2006.

(51) Int. Cl.
*B01F 7/16* (2006.01)

(52) U.S. Cl. ..... 366/331

(58) Field of Classification Search ..... 366/251, 366/265, 330.1, 331
See application file for complete search history.

(56) References Cited

U.S. PATENT DOCUMENTS

| | | | | |
|---|---|---|---|---|
| 2,162,400 | A | | 6/1939 | Heath |
| 2,797,903 | A | | 7/1957 | Urban |
| 3,647,397 | A | | 3/1972 | Coleman |
| 4,711,582 | A | | 12/1987 | Kennedy |
| 4,805,799 | A | | 2/1989 | Robbins, III |
| 4,828,395 | A | * | 5/1989 | Saito et al. ..... 366/143 |
| 4,964,333 | A | | 10/1990 | Bravo |
| 4,968,624 | A | | 11/1990 | Bacehowski et al. |
| 5,458,771 | A | | 10/1995 | Todd |
| 5,584,577 | A | | 12/1996 | Thies |

(Continued)

FOREIGN PATENT DOCUMENTS

EP 0 239 962 A2 10/1987

(Continued)

*Primary Examiner*—David L Sorkin
(74) *Attorney, Agent, or Firm*—Workman Nydegger

(57) ABSTRACT

A mixing system includes a housing and a motor mount disposed on the housing and having a passage extending therethrough. A dive motor is coupled with the motor mount for selectively rotating the motor mount relative to the housing. A rotational assembly includes a hub having a passageway extending therethrough and a casing at least partially encircling the hub, the hub being rotatable to the casing. The rotational assembly is removably coupled to the housing so that the passageway of the hub aligns with the passage of the motor mount.

35 Claims, 14 Drawing Sheets

U.S. PATENT DOCUMENTS

| | | | | |
|---|---|---|---|---|
| 5,727,878 | A | 3/1998 | Sullivan, Jr. | |
| 5,941,635 | A | 8/1999 | Stewart | |
| 5,988,422 | A | 11/1999 | Vallot | |
| 6,071,005 | A | 6/2000 | Ekambaram et al. | |
| 6,076,457 | A | 6/2000 | Vallot | |
| 6,083,587 | A | 7/2000 | Smith et al. | |
| 6,245,555 | B1 | 6/2001 | Curtis | |
| 6,494,613 | B2 | 12/2002 | Terentiev | |
| 6,670,171 | B2 | 12/2003 | Carll | |
| 6,709,862 | B2 | 3/2004 | Curtis | |
| 6,908,223 | B2 | 6/2005 | Bibbo et al. | |
| 7,070,318 | B2 * | 7/2006 | Renfro | 366/143 |
| 7,384,783 | B2 * | 6/2008 | Kunas et al. | 435/289.1 |
| 2002/0145940 | A1 | 10/2002 | Terentiev | |
| 2004/0062140 | A1 | 4/2004 | Cadogan et al. | |
| 2004/0136265 | A1 | 7/2004 | Meier et al. | |
| 2004/0190372 | A1 | 9/2004 | Goodwin et al. | |
| 2005/0002274 | A1 | 1/2005 | Terentiev | |
| 2005/0276158 | A1 * | 12/2005 | Thomas | 366/250 |

FOREIGN PATENT DOCUMENTS

| | | | |
|---|---|---|---|
| EP | 0 343 885 | A1 | 11/1989 |
| GB | 2 202 549 | A1 | 9/1988 |
| WO | WO 2005/068059 | A1 | 7/2005 |

* cited by examiner

MIXING SYSTEMS AND RELATED MIXERS

CROSS-REFERENCE TO RELATED APPLICATIONS

This application is a continuation-in-part of U.S. patent application Ser. No. 11/112,834, filed Apr. 22, 2005 and claims priority to U.S. Provisional Application Ser. No. 60/784,403, filed Mar. 20, 2006, which are incorporated herein by specific reference.

BACKGROUND OF THE INVENTION

1. The Field of the Invention

The present invention relates to mixing systems that can be used in the biopharmaceutical industry.

2. The Relevant Technology

The biopharmaceutical industry uses a broad range of mixing systems for a variety of processes such as in the preparation of media and buffers and in the growing of cells and microorganisms in bioreactors. Many conventional mixing systems, including bioreactors, comprise a rigid tank that can be sealed closed. A drive shaft with impeller is rotatably disposed within the tank. The impeller functions to suspend and mix the components.

In many cases, great care must be taken to sterilize and maintain the sterility of the mixing system so that the culture or other product does not become contaminated. Accordingly, between the production of different batches, the mixing tank, mixer, and all other reusable components that contact the processed material must be carefully cleaned to avoid any cross contamination. The cleaning of the structural components is labor intensive, time consuming, and costly. For example, the cleaning can require the use of chemical cleaners such as sodium hydroxide and may require steam sterilization as well. The use of chemical cleaners has the additional challenge of being relatively dangerous, and cleaning agents can be difficult and/or expensive to dispose of once used.

The operation and maintenance of such mixing systems can be daunting for many facilities, especially where it is desirable to make a large number of smaller batches. Accordingly, what is needed are mixing systems that require minimum cleaning or sterilization, can be used for mixing or suspending a broad range of materials, can consistently provide a sterile environment, and are relatively inexpensive and easy to operate.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

The present invention relates to mixing systems that are primarily designed for use in the biopharmaceutical industry but can also have applicability in a wide variety of other industries. By way of example, the mixing systems disclosed herein can be used as a single use bioreactor for growing cells, microorganisms, and other biological cultures. The mixing systems can also be used for hydrating powders, such as in the production of media or buffers, and in the manufacturing, treating, and/or processing of a wide variety of other liquid based products.

The inventive mixing systems can be used in sterile or non-sterile processing and are designed so that a majority of the system components that contact the material being processed can be disposed of after each use. As a result, the inventive mixing systems substantially eliminate the burden of cleaning and sterilization required by conventional stainless steel mixing systems. This feature also ensures that sterility can be consistently maintained during repeated processing of multiple batches. In view of the foregoing, and the fact that the inventive systems are easily scalable, relatively low cost, and easily operated, the inventive mixing systems can be used in a variety of industrial and research facilities that previously outsourced such processing.

It is noted that the inventive mixing systems disclosed herein represent improvements and/or modifications to the mixing systems previously disclosed in U.S. patent application Ser. No. 11/112,834, filed Apr. 22, 2005 ("the '834 application") that is hereby incorporated by specific reference. As such, further disclosure with regard to the inventive mixing systems disclosed herein and their corresponding components and uses, along with related alternative embodiments, can be found in the '834 application.

Figure 1:
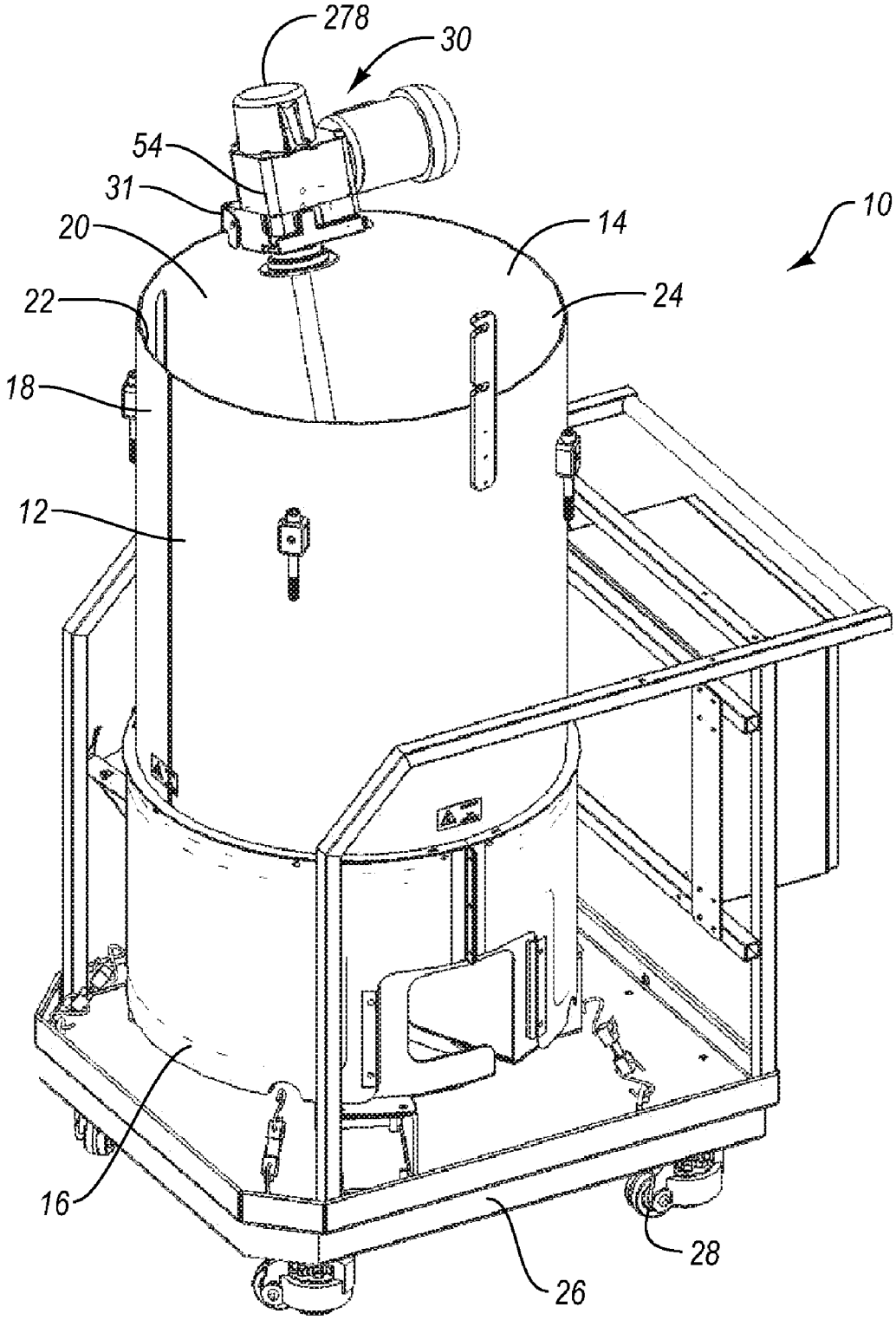
FIG. 1 is a perspective view of one embodiment of an inventive mixing system.

Depicted in FIG. 1 is one embodiment of an inventive mixing system 10 incorporating features of the present invention. In general, mixing system 10 comprises a rigid support housing 12 having an interior surface 14 that extends between a lower end 16 and an upper end 18. Interior surface 14 bounds a compartment 20. An annular lip 22 is formed at upper end 18 and bounds an opening 24 to compartment 20. Lower end 16 of support housing 12 rests on a cart 26 having wheels 28. Cart 26 enables selective movement and positioning of mixing system 10. In alternative embodiments support housing 12 can be fixed at a designated location.

Although support housing 12 is shown as having a substantially cylindrical configuration, in alternative embodiments support housing 12 can have any desired shape capable of at least partially bounding a compartment. Furthermore, it is appreciated that support housing 12 can be scaled to any desired size. For example, it is envisioned that support housing 12 can be sized so that compartment 20 can hold a volume of less than 50 liters or more than 1,000 liters. Support housing 12 is typically made of metal, such as stainless steel, but can also be made of other materials capable of withstanding the applied loads of the present invention.

Mixing system 10 also comprises a mixer 30 coupled with a support housing 12 by a bracket 31. Depicted in FIG. 2A, mixer 30 is shown being coupled with a container 32. Container 32 bounds a compartment 34 in which a portion of mixer 30 is disposed. In the embodiment depicted, container 32 comprises a flexible bag. Although not illustrated, it is appreciated that container 32 can be formed with or connected to a variety of ports, probes, secondary containers, spargers, and/or other fittings at various locations depending on the intended use for mixing system 10. Examples of such ports and attachments are disclosed in the '834 application and in the United States Patent Application entitled "Gas Sparger and Related Container Systems" filed Mar. 20, 2006 in the name of Michael E. Goodwin et al. and in the United States Patent Application entitled "Tube Ports and Related Container Systems" filed Mar. 20, 2006 in the name of Michael E. Goodwin et al., which applications are incorporated herein by specific reference.

In the depicted embodiment, container 32 has an opening 36 that is sealed to a rotational assembly 38 that will be discussed below in greater detail. As a result, compartment 34 is sealed closed so that it can be used in processing sterile fluids. In contrast, in the embodiment depicted in FIG. 2B, mixer 30 operates with a container 40 that partially bounds a compartment 42. Container 40 comprises a flexible open top liner. That is, container 40 has an annular lip 44 that bounds an exposed opening 46 to compartment 42. Container 40 is thus used in the processing of non-sterile fluids.

During use, both containers are disposed within chamber 20 of support housing 12 depicted in FIG. 1. The containers are supported by support housing 12 during use and can subsequently be disposed of following use. In one embodiment, the containers are comprised of a flexible, water impermeable material such as a low-density polyethylene or other polymeric sheets having a thickness in a range between about 0.1 mm to about 5 mm with about 0.2 mm to about 2 mm being more common. Other thicknesses can also be used. The material can be comprised of a single ply material or can comprise two or more layers which are either sealed together or separated to form a double wall container. Where the layers are sealed together, the material can comprise a laminated or extruded material. The laminated material comprises two or more separately formed layers that are subsequently secured together by an adhesive.

The extruded material comprises a single integral sheet that comprises two or more layers of different materials that can be separated by a contact layer. All of the layers are simultaneously co-extruded. One example of an extruded material that can be used in the present invention is the HyQ CX3-9 film available from HyClone Laboratories, Inc. out of Logan, Utah. The HyQ CX3-9 film is a three-layer, 9 mil cast film produced in a cGMP facility. The outer layer is a polyester elastomer coextruded with an ultra-low density polyethylene product contact layer. Another example of an extruded material that can be used in the present invention is the HyQ CX5-14 cast film also available from HyClone Laboratories, Inc. The HyQ CX5-14 cast film comprises a polyester elastomer outer layer, an ultra-low density polyethylene contact layer, and an EVOH barrier layer disposed therebetween. In still another example, a multi-web film produced from three independent webs of blown film can be used. The two inner webs are each a 4 mil monolayer polyethylene film (which is referred to by HyClone as the HyQ BM1 film) while the outer barrier web is a 5.5 mil thick 6-layer coextrusion film (which is referred to by HyClone as the HyQ BX6 film).

The material is approved for direct contact with living cells and is capable of maintaining a solution sterile. In such an embodiment, the material can also be sterilizable such as by ionizing radiation. Examples of materials that can be used in different situations are disclosed in U.S. Pat. No. 6,083,587 which issued on Jul. 4, 2000 and U.S. Patent Publication No. US 2003-0077466 A1, published Apr. 24, 2003 which are hereby incorporated by specific reference.

In one embodiment, the containers comprise a two-dimensional pillow style bag wherein two sheets of material are placed in overlapping relation and the two sheets are bounded together at their peripheries to form the internal compartment. Alternatively, a single sheet of material can be folded over and seamed around the periphery to form the internal compartment. In another embodiment, the containers can be formed from a continuous tubular extrusion of polymeric material that is cut to length and is seamed closed at the ends.

In still other embodiments, the containers can comprise a three-dimensional bag that not only has an annular side wall but also a two dimensional top end wall and a two dimensional bottom end wall. Three dimensional containers comprise a plurality of discrete panels, typically three or more, and more commonly four or six. Each panel is substantially identical and comprises a portion of the side wall, top end wall, and bottom end wall of the container. Corresponding perimeter edges of each panel are seamed. The seams are typically formed using methods known in the art such as heat energies, RF energies, sonics, or other sealing energies.

In alternative embodiments, the panels can be formed in a variety of different patterns. Further disclosure with regard to one method of manufacturing three-dimensional bags is disclosed in U.S. Patent Publication No. US 2002-0131654 A1 that was published Sep. 19, 2002 of which the drawings and Detailed Description are hereby incorporated by reference.

It is appreciated that the containers can be manufactured to have virtually any desired size, shape, and configuration. For example, the containers can be formed having a compartment sized to 10 liters, 30 liters, 100 liters, 250 liters, 500 liters, 750 liters, 1,000 liters, 1,500 liters, 3,000 liters, 5,000 liters, 10,000 liters or other desired volumes. Although the containers can be any shape, in one embodiment the containers are specifically configured to be complementary or substantially complementary to chamber 20 of support housing 12.

In any embodiment, however, it is desirable that when the containers are received within chamber 20, the containers are uniformly supported by support housing 12. Having at least generally uniform support of the containers by support housing 12 helps to preclude failure of the containers by hydraulic forces applied to the containers when filled with fluid.

Although in the above discussed embodiment the containers have a flexible, bag-like configuration, in alternative embodiments it is appreciated that the containers can comprise any form of collapsible container or semi-rigid container. The containers can also be transparent or opaque and can have ultraviolet light inhibitors incorporated therein.

Figure 3:
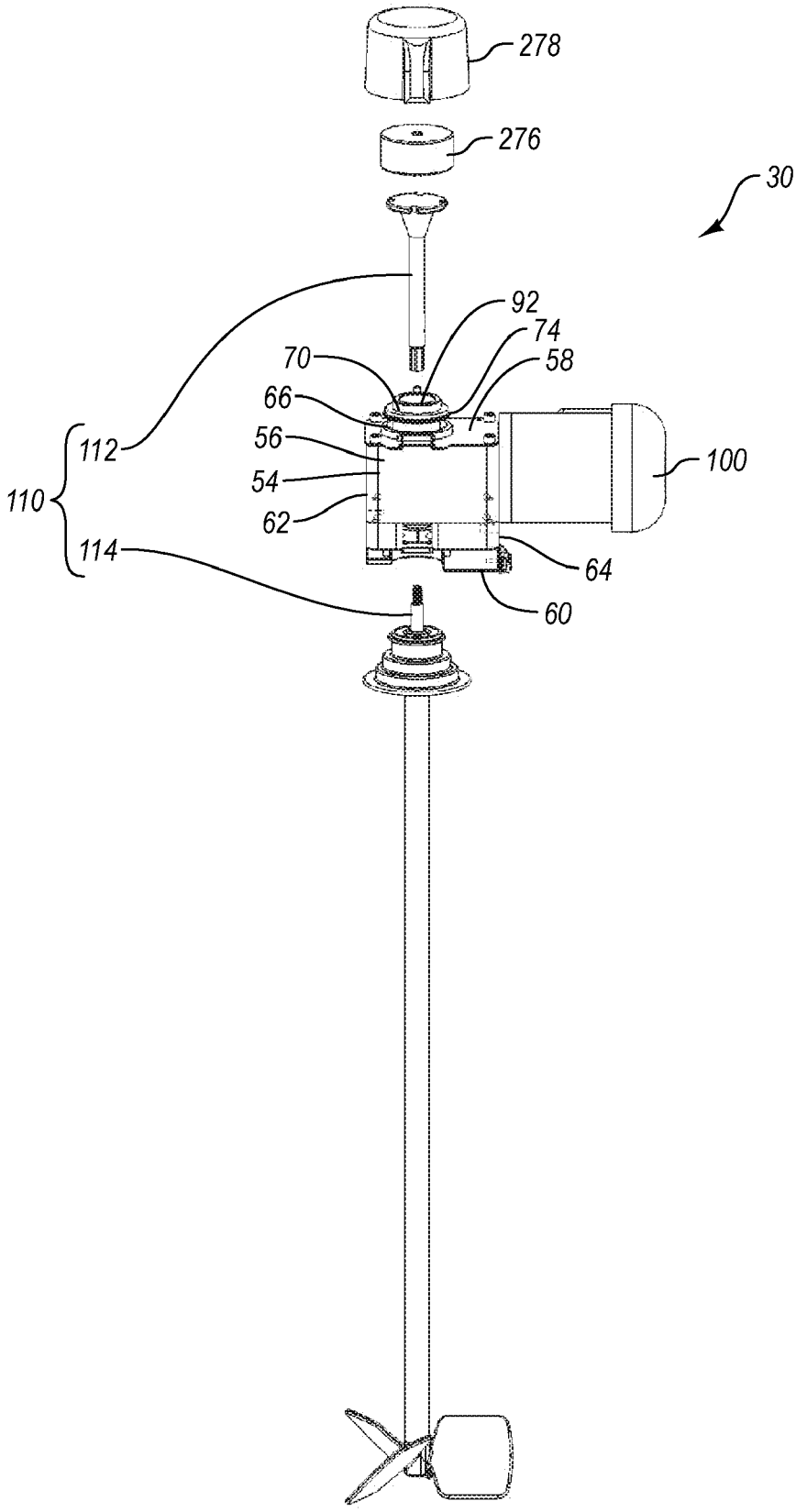
FIG. 3 is a partially exploded perspective view of the mixer shown in FIGS. 2A and 2B.

Turning to FIG. 3, mixer 30 comprises a housing 54 having a front face 56 that extends between a top surface 58 and an opposing bottom surface 60. Front face 56 also extends between a first side 62 and an opposing second side 64. An opening 66 extends through housing from top surface 58 to bottom surface 60.

Figure 4:
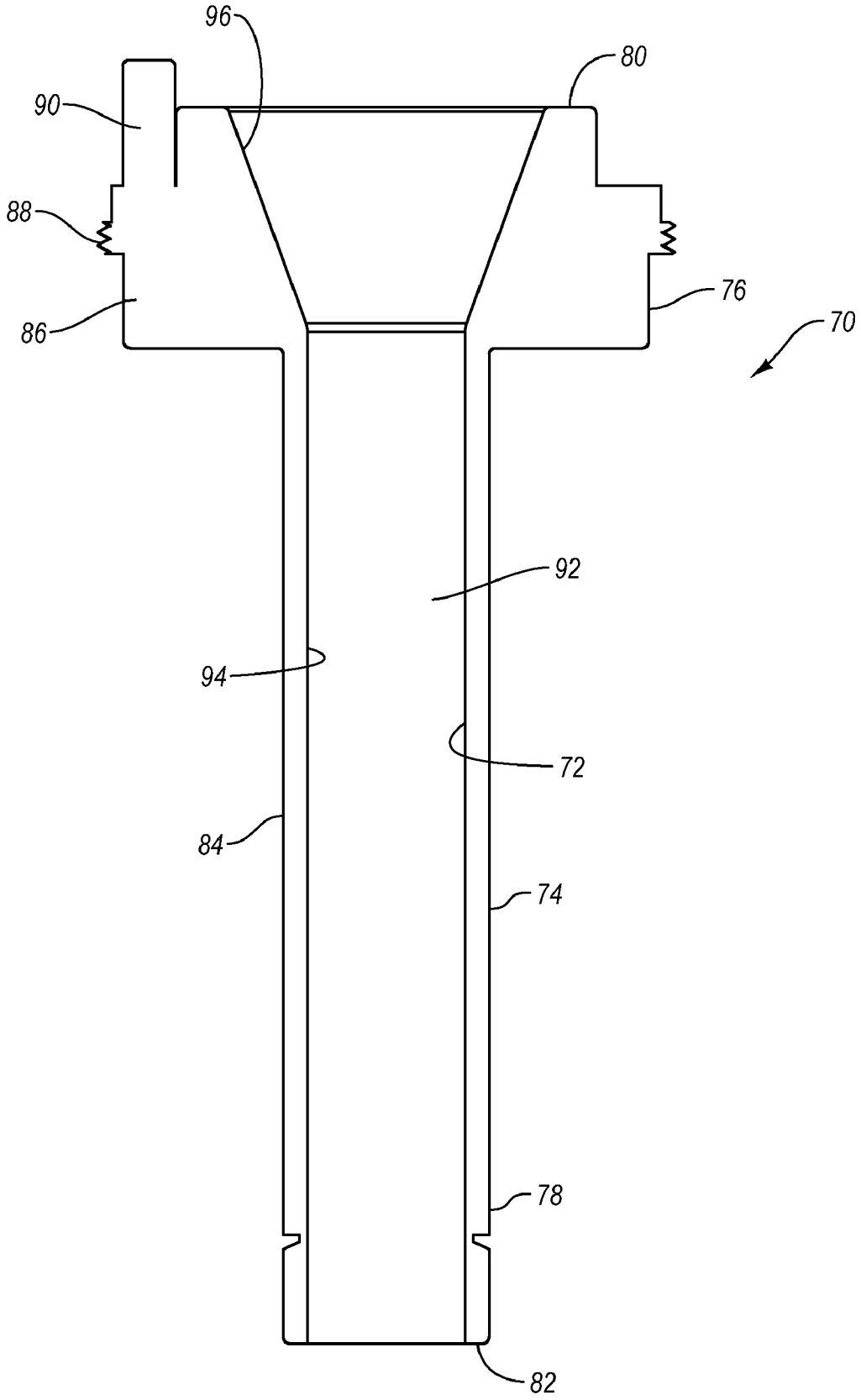
FIG. 4 is a cross sectional side view of a motor mount of the mixer shown in FIG. 3.
Figure 5:
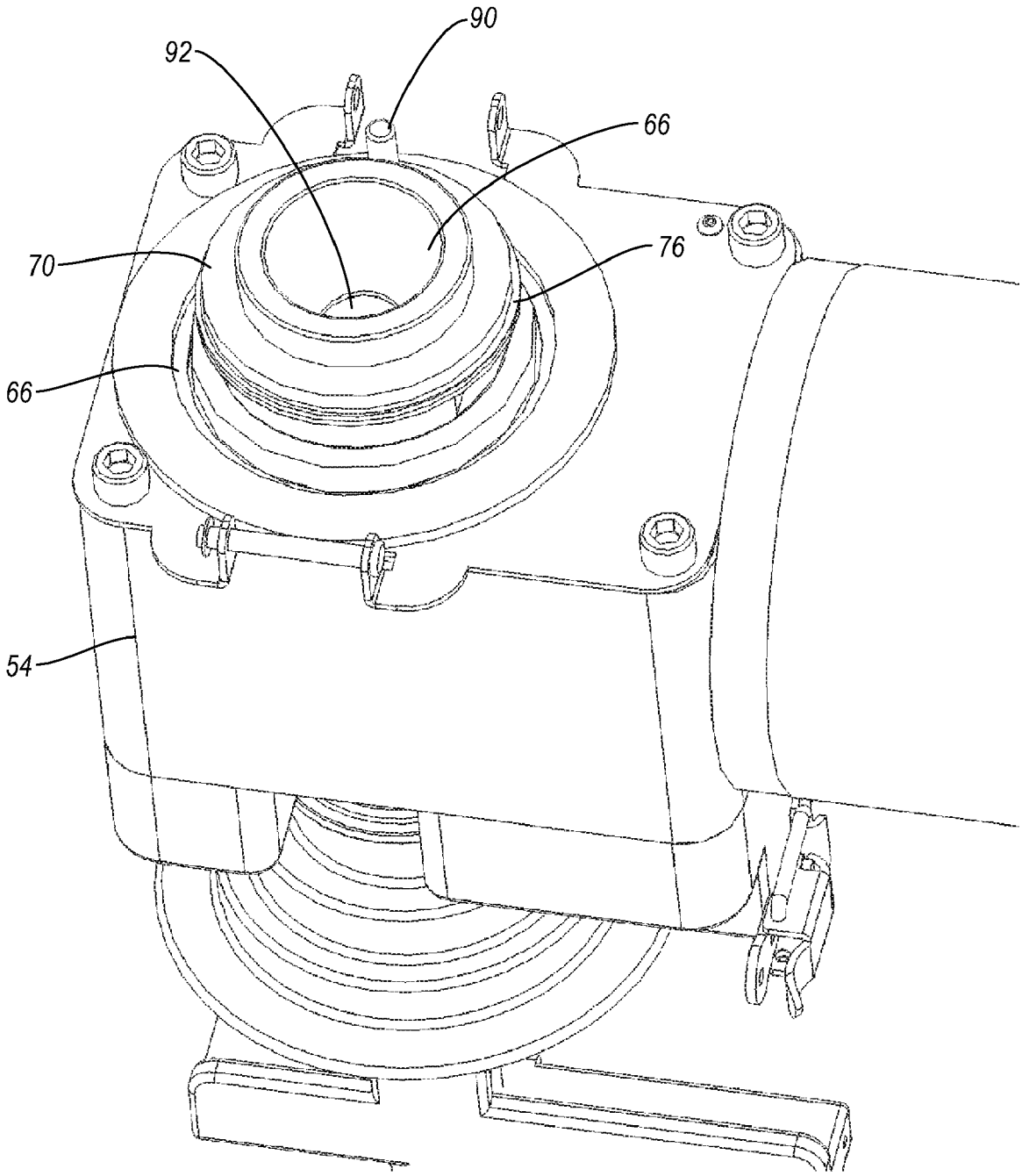
FIG. 5 is a top perspective view of the housing shown in FIG. 3 having the motor mount of FIG. 4 secured thereto.

A motor mount 70 is rotatably secured within opening 66 of housing 54. As depicted in FIGS. 4 and 5, motor mount 70 has an interior surface 72 and an exterior surface 74 each extending between a first end 76 and an opposing second end 78. First end 76 terminates at a first end face 80 while second end 78 terminates at a second end face 82. Motor mount 70 generally comprises an elongated substantially cylindrical stem 84 formed at second end 78 and an enlarged radially outwardly projecting flange 86 formed at first end 76. Engagement threads 88 radially encircle the side wall of flange 86. As will be discussed below in greater detail, a locking pin 90 outwardly projects from a top surface of flange 86.

Interior surface 72 of motor mount 70 bounds a passage 92 that extends between end faces 80 and 82. Interior surface 72 includes a substantially cylindrical transition portion 94 that extends along the length of stem 84 and a substantially frustoconical engaging portion 96 that extends along flange 86. As will be discussed below in greater detail, the configuration of engaging portion 96 helps facilitate proper centering of the drive shaft and helps minimize or eliminate fret corrosion.

Returning to FIG. 3, a drive motor 100 is mounted on side 64 of housing 54. Drive motor 100 engages with stem 84 of motor mount 70 so as to facilitate select rotation of motor mount 70 relative to housing 54.

Figure 6:
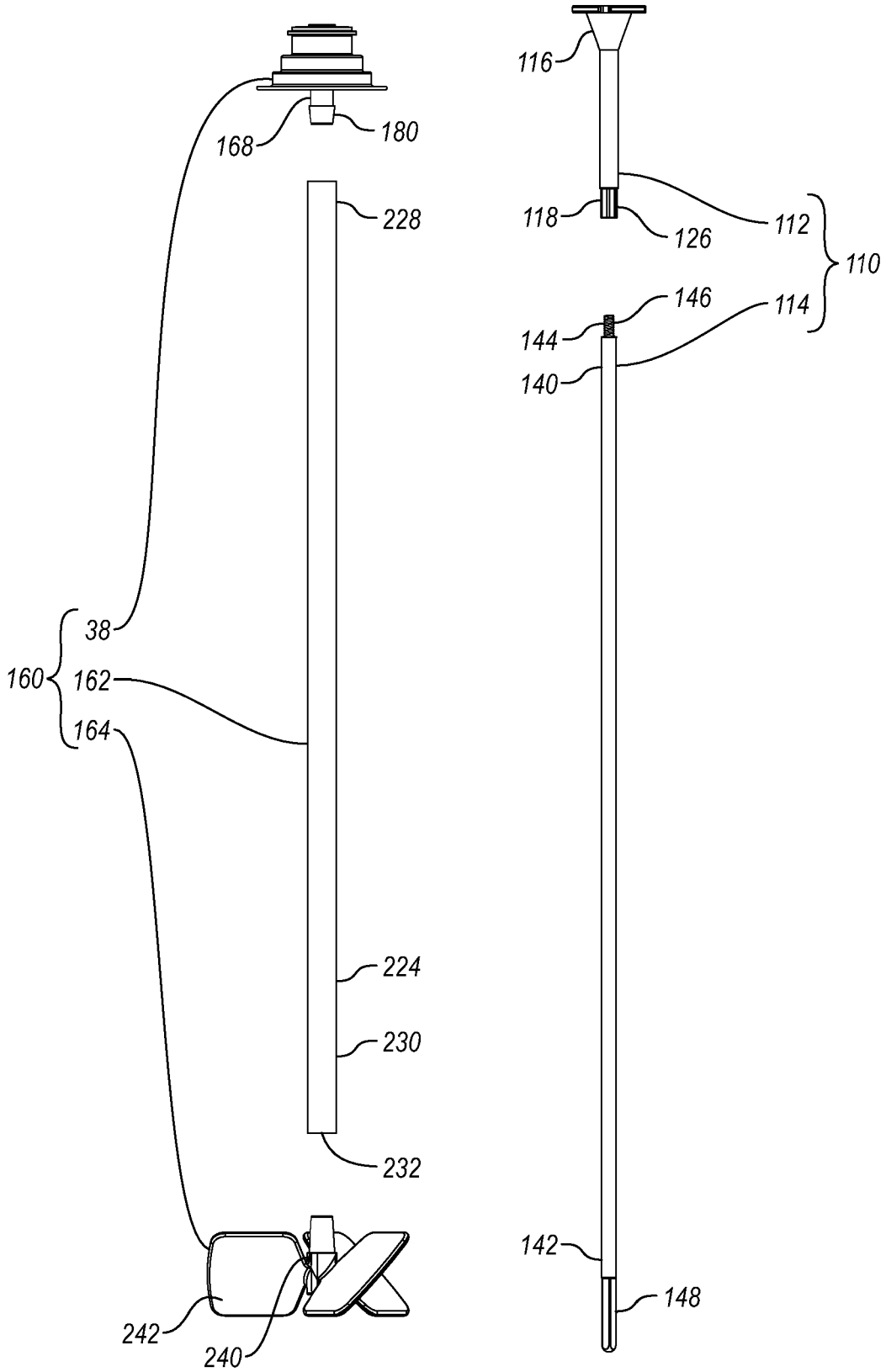
FIG. 6 is a partially exploded side view of a drive rod and impeller assembly shown in FIG. 3.
Figure 7:
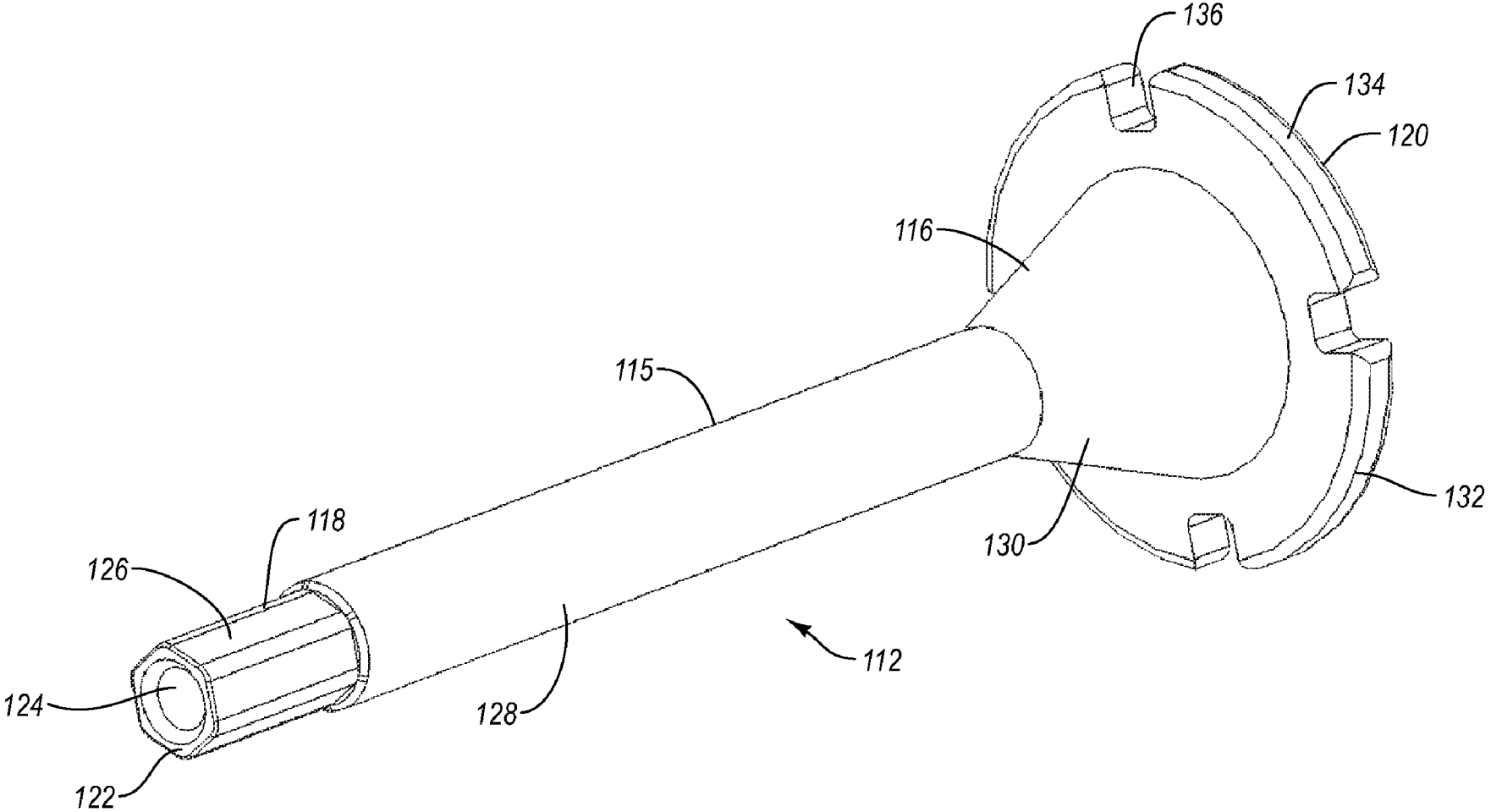
FIG. 7 is an enlarged perspective view of a head section of the drive shaft shown in FIG. 6.

A drive shaft 110 is configured to pass through passage 92 of motor mount 70 and thus through housing 54. Turning to FIG. 6, drive shaft 110 comprises a head section 112 and a shaft section 114 that are connected together. As depicted in FIG. 7, head section 112 has an exterior surface 115 extending between a first end 116 and an opposing second end 118. First end 116 terminates at a first end face 120 while second end 118 terminates at a second end face 122. Recessed into second end face 122 is a threaded socket 124. Head section 112 is comprised of a connecting portion 126 extending back from second end face 122. As will be discussed below in greater detail, connecting portion 126 has a noncircular transverse cross section so that it can facilitate locking engagement with another structure. In the embodiment depicted, connection portion 126 has a polygonal transverse cross section. However, other noncircular shapes can also be used.

Extending back from connecting portion 126 is a substantially cylindrical central portion 128 head section 112. Extending from central portion 128 substantially frustoconical engaging portion 130. Engaging portion 130 has a configuration complimentary to frustoconical engaging portion 96 of motor mount 70 so that engaging portions 96 and 130 can be complementary mated to facilitate contacting engagement between motor mount 70 and drive shaft 110.

Finally, a substantially circular plate section 132 extends between engaging portion 130 and first end face 120. Plate section 132 extends to a perimeter edge 134 that radially outwardly projects beyond engaging portion 130. A plurality of spaced apart notches 136 are formed on perimeter edge 134. As will be discussed below in greater detail, notches 136 are designed to receive locking pin 90 of motor mount 70.

Returning to FIG. 6, shaft section 114 of drive shaft 110 has a first end 140 and an opposing section end 142. First end 140 terminates at a terminus 144 having encircling threads 146 formed thereat. Terminus 144 is configured to be threadedly received within socket 124 of head section 112 so as to rigidly secure head section 112 to shaft section 114, thereby forming drive shaft 110. In alternative embodiments, it is appreciated that there are a variety of alternative connection techniques that can be used to secure head section 112 to drive section 114. For example, the structures can be connected together by press fit, welding, adhesive, clamps, or other conventional fasteners. The assembled drive shaft 110 thus extends between first end 116 and second end 142. Second end 142 of shaft section 114 ends at a terminus 148 having a noncircular transverse cross section. That is, as with connecting portion 128 head section 112 previously discussed, terminus 148 is configured to couple with another structure as is discussed below in great detail such that rotation of drive shaft 110 facilities rotation of the structure. In this regard, terminus 148 can have any noncircular transverse cross section. In the embodiment depicted, terminus 148 has a polygonal transverse cross section although elliptical, irregular, and other noncircular transverse cross sections will also work.

In one embodiment, head section 112 and shaft section 114 are made of different materials. By way of example and not by limitation, in one embodiment head section 112 can be made of a polymeric material such as a polyacetal material, nylon, or polypropylene. One preferred type of polyacetal material is sold under the trademark DELRIN®. In alternative embodiments, however, head section 112 can also be made of ceramics, composites, metals, such as aluminum, stainless steel, other metal alloys, or other materials. Shaft section 114 can also be made of any of the materials as discussed above. However, in one typical embodiment, head section 112 is made of DELRIN® while shaft section 114 is made of aluminum. As will be discussed below in greater detail, this configuration minimizes costs while helping to minimize or eliminate fret corrosion. In still other embodiments, it is appreciated that drive shaft 110 can be made as a single integral member entirely formed from the same material. That is, all of drive shaft 110 can be made of all the same alternative materials as previously discussed above with regard to head section 112.

Figure 8:
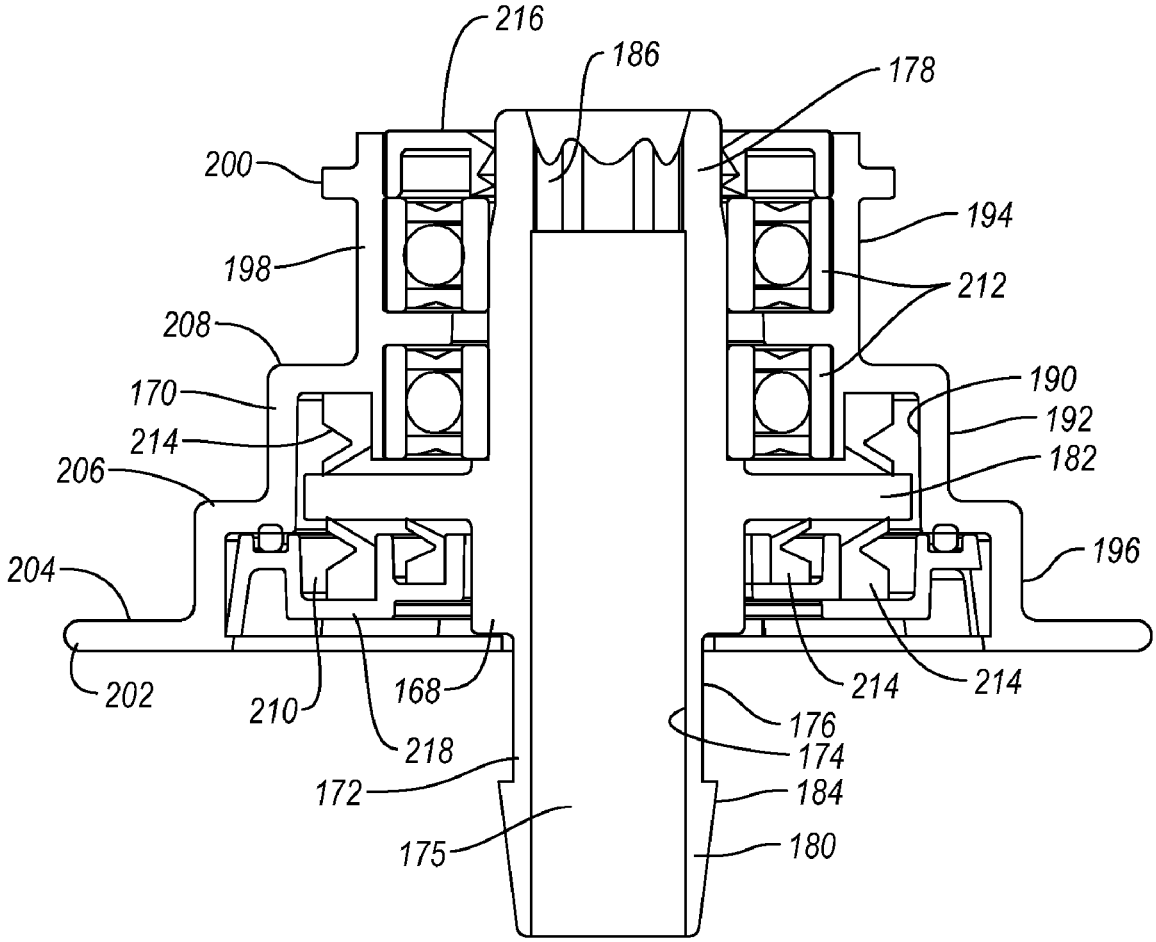
FIG. 8 cross sectional side view of a rotational assembly shown in FIG. 6.

As also depicted in FIG. 6, mixer 30 further comprises an impeller assembly 160. Impeller assembly 160 comprises rotational assembly 38, an elongated connector 162, and an impeller 164. As depicted in FIG. 8, rotational assembly 38 comprises a hub 168 that is partially encircled by a casing 170. Hub 168 comprises an elongated stem 172 having an interior surface 174 and an exterior surface 176 each extending between a first end 178 and an opposing section end 180. Encircling and radially outwardly projecting from exterior surface 176 between opposing ends 178 and 180 is a support flange 182. Encircling and radially outwardly projecting from second end 180 of stem 172 is an annular barb 184.

Interior surface 174 bounds a passage 175 that extends through stem 172. Interior surface 174 includes a connecting portion 186 formed at first end 178. Connecting portion 186 has a noncircular transverse cross section that is complementary to the transverse cross section of connecting portion 126 of drive shaft 110. Accordingly, when connecting portion 126 of drive shaft 110 is received within connecting portion 186 of hub 168, drive shaft 110 engages hub 168 that rotation of drive shaft 110 facilitates complementary rotation of hub 168. It is appreciated that there are a variety of complementary configurations that can be used by connection portions 126 and 186. Furthermore, connecting portions 126 and 186 need not be completely complementary but merely configured such that connecting portion 126 interlocks with connecting portion 186. In still other embodiments, it is appreciated that other fasteners or connecting techniques can be used to engage drive shaft 110 to hub 168.

In the depicted embodiment, the remainder of interior surface 174 of hub 168, extending between connecting portion 186 and second end 180, has a substantially cylindrical transverse cross section. In alternative embodiments, however, this remainder of interior surface 174 can be any desired transverse cross section that will allow drive shaft 110 to pass therethrough. For example, if desired, all of interior surface 174 can have the same transverse cross section as connecting portion 186.

Figure 2A:
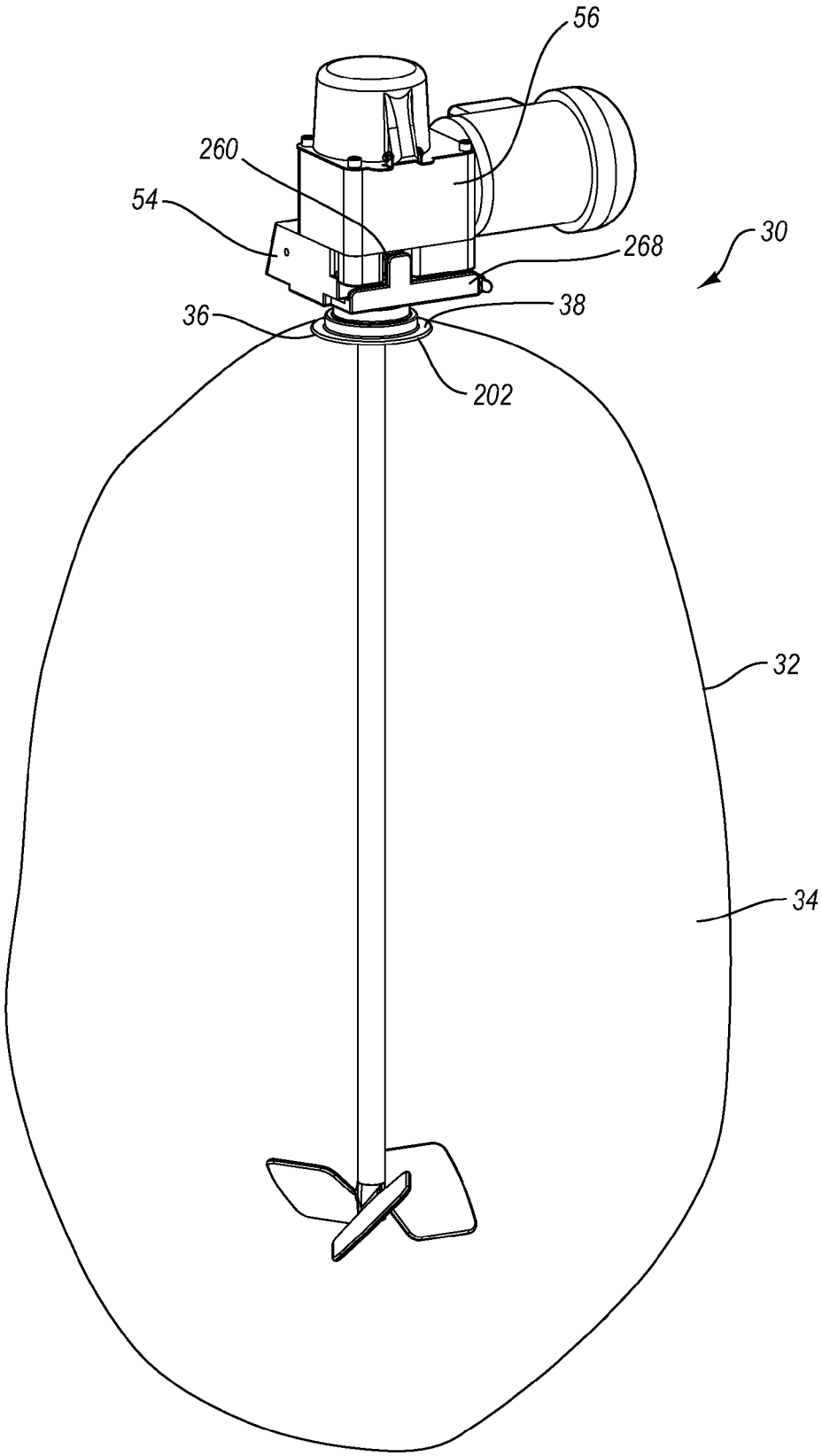
FIG. 2A is a perspective view of a mixer with closed container that can be used as part of the mixing system depicted in FIG. 1.
Figure 2B:
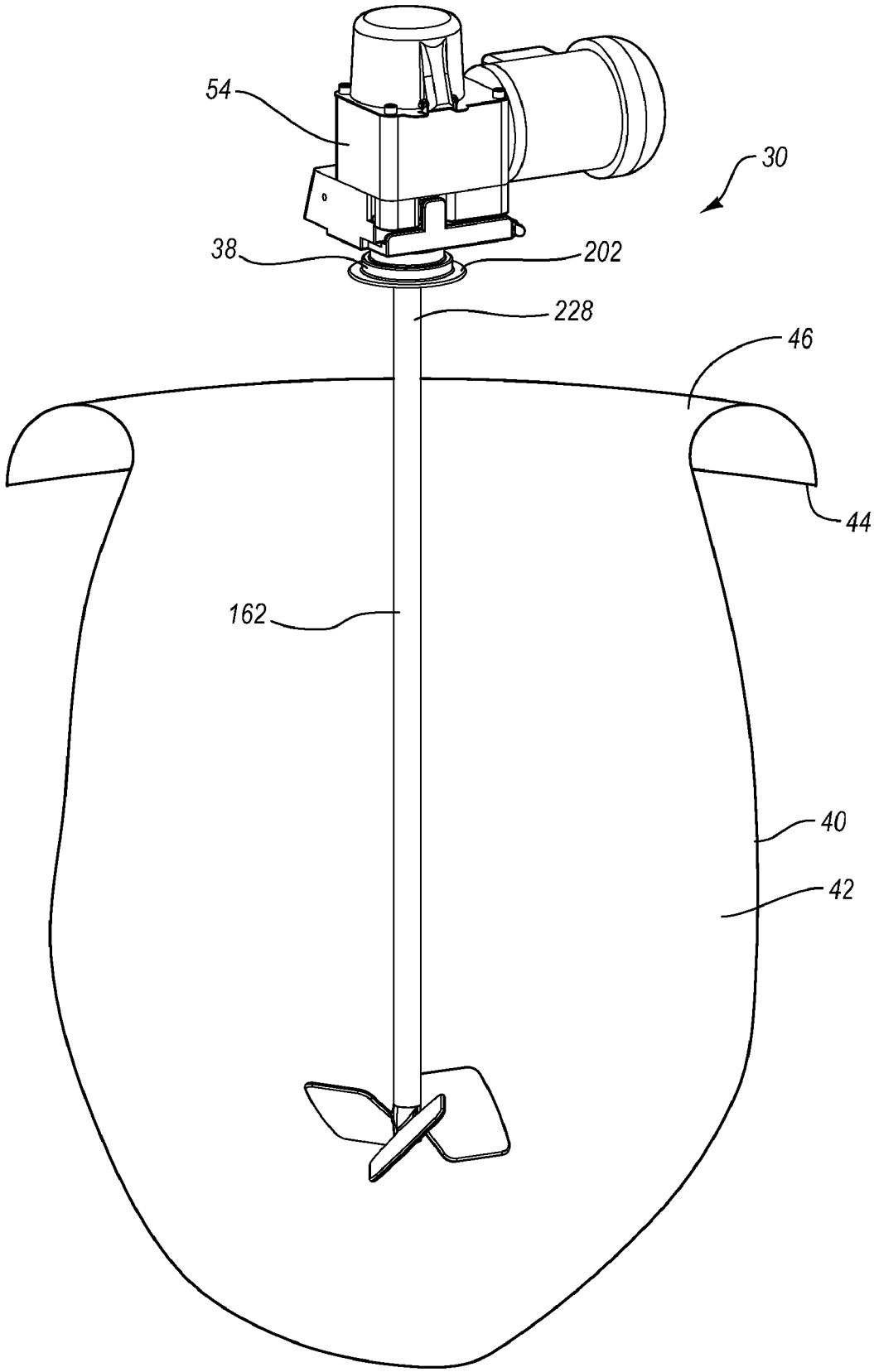
FIG. 2B is a perspective view of a mixer with open container that can be used with the mixing system depicted in FIG. 1.

As also depicted in FIG. 8, casing 170 has an interior surface 190 and an exterior surface 192 extending between a first end 194 and an opposing second end 196. Formed at first end 194 is an annular collar 198. An annular support flange 200 encircles and radially outwardly projects from collar 198. Casing 170 further comprises an annular sealing flange 202 formed at second end 196. Sealing flange 202 has a top surface 204 against which container 32 can be sealed, such as by welding or other conventional techniques as illustrated in FIG. 2A. Extending between sealing flange 202 and collar 198 are two annular shoulders 206 and 208 consecutively inwardly step. Interior surface 190 of casing 170 bounds an opening 210 extending through casing 170. Hub 168 rotatably disposed within opening 210 so that hub 168 can rotate relative to casing 170. To facilitate ease in rotation, a pair of bearing assemblies 212 encircle hub 168 and extend between hub 168 and casing 170. Furthermore, a plurality of seals 214 are disposed within opening 210 so as to form a liquid type seal between hub 168 and casing 170.

Finally, a first retainer 216 encircles hub 168 at first end 178 while a second retainer 218 circles hub 168 toward second end 180. Retainers 216 and 218 are disposed within opening 210 and extend between hub 168 and casing 170 so as to secure hub 168 within casing 170 and to support and maintain bearing assemblies 212 and seals 214 within opening 210. As with the other components of mixing system 10 disclosed herein, it is noted that a variety of alternative designs for rotational assembly e disclosed in the '834 application.

Returning to FIG. 6, casing 162 is an elongated tubular member having an exterior surface 224 and an interior surface 226 (FIG. 9) extending between a first end 228 and an opposing second end 230. Interior surface 226 bounds a passage 232 that extends through connector 162 along the length thereof. Connector 162 can be made out of a variety of rigid or flexible materials such as metals, plastics, composites, or others. Connector 162, however, is typically not subject to any significant loads and primarily functions as a seal for drive shaft 110. As such, to minimize expense, connector 162 is typically made from a flexible polymeric material such as that used in conventional tubing. This further enables connector 162 to be coiled, bent, or folded during sterilization, transport, and/or storage so as to minimize space. Connector 162 is coupled with rotational assembly 38 inserting second end 180 of hub 168 into passage 232 of connector 162 at first end 2228 thereof. A plastic pull tie, clamp, crimp, or other fastener can then be cinched around first end 228 so as to form a liquid tight sealed engagement between hub 168 and connector 162.

Figure 9:
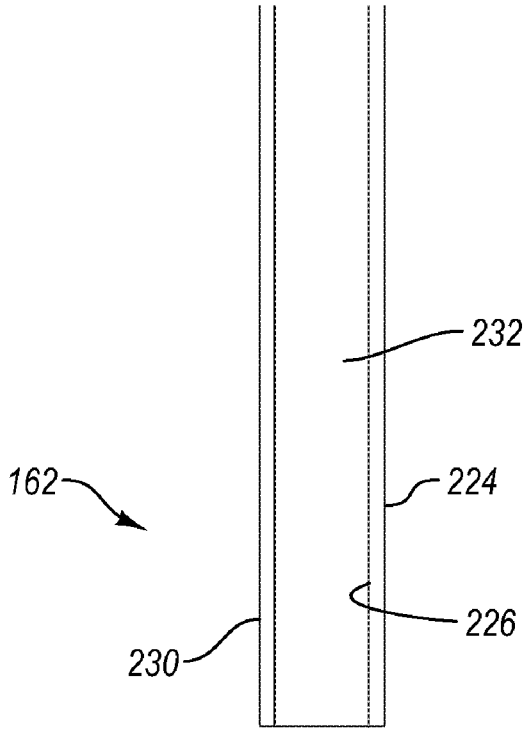
FIG. 9 is a cross sectional side view of the impeller and connector shown in FIG. 6.
Figure 9:
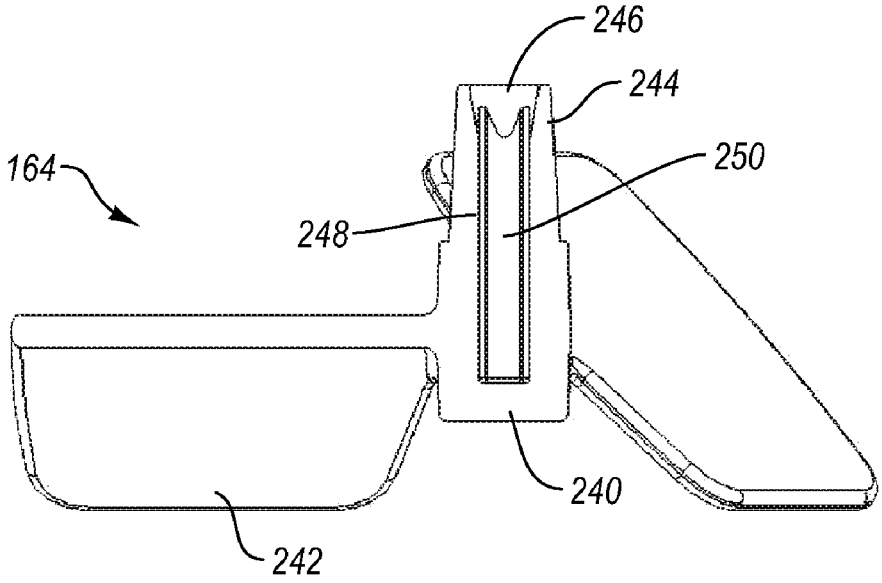

As also depicted in FIG. 6 and in FIG. 9 with greater detail, impeller 164 comprises a central hub 240 having a plurality of fins 242 radially outwardly projecting therefrom. Hub 240 has a first end 244 with a cavity 246 recessed in thereat. An insert 248 is received within cavity 246 and bounds an open socket 250. Socket 250 has a noncircular transverse cross section that is complementary to terminus 148 of drive shaft 110 (FIG. 6). Accordingly, as will be discussed below in greater detail, when terminus 148 is received within socket 250, terminus 148 gages with impeller 164 such that rotation of drive shaft 110 facilities rotation of impeller 164. It is again appreciated that terminus 148 and socket 250 can have a variety of alternative complementary or interlocking configurations that enable engagement between terminus 148 drive shaft 110 and impeller 164. Alternative press fit and mechanical fastening techniques can also be used.

In one embodiment, hub 240 and fins 242 of impeller 164 are molded from a polymeric material while insert 248 formed from a metallic material. In alternative embodiments, hub 240 and fins 242 can be made of metal, composite, or a variety of other materials. Furthermore, insert 248 can be eliminated in that cavity 246 can be configured to form socket 250.

Impeller 164 is attached to connector 162 by inserting first end 244 of hub 240 within passage 232 of connector 162 at second end 230. A pull tie clamp, crimp, or other type of fastener can then be cinched around second end 230 of connector 162 so as to form a liquid tight sealed engagement between impeller 164 and connector 162.

Either prior to or following the complete assembly of impeller assembly 160 as discussed above, container 32 is sealed to sealing flange 202 as depicted in FIG. 2A. In this assembled state, compartment 34 of container 32 is sealed closed. The assembled impeller assembly 160 and container 32 is a disposable unit that when in the assembled state can be sterilized by conventional processes such as radiation. Again, because of the flexible nature of connector 162 and container 32, container 32 can be collapsed and folded into a compact state for sterilization, transport, and storage. Depending on its intended use, various ports, tubes, probes, secondary containers and the like can be mounted on or connected to container 32 prior to or subsequent to sterilization of container 32.

Figure 10:
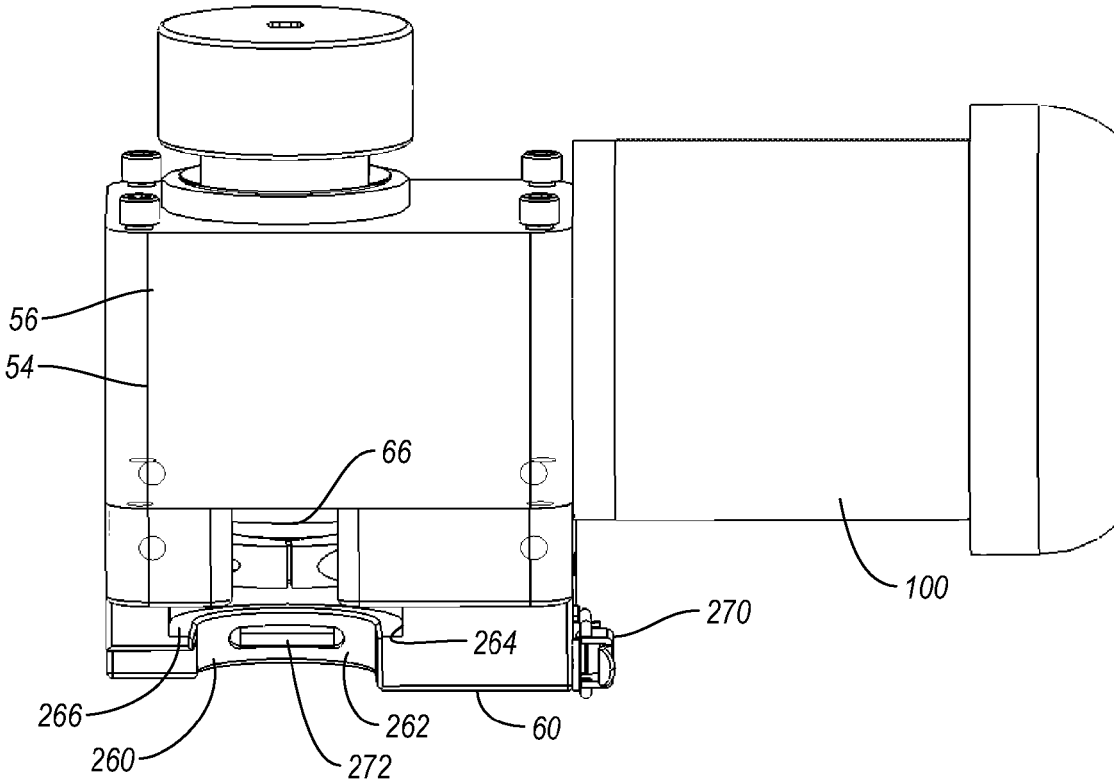
FIG. 10 is an enlarged perspective view of the housing and rotational assembly shown in FIG. 3.
Figure 10:
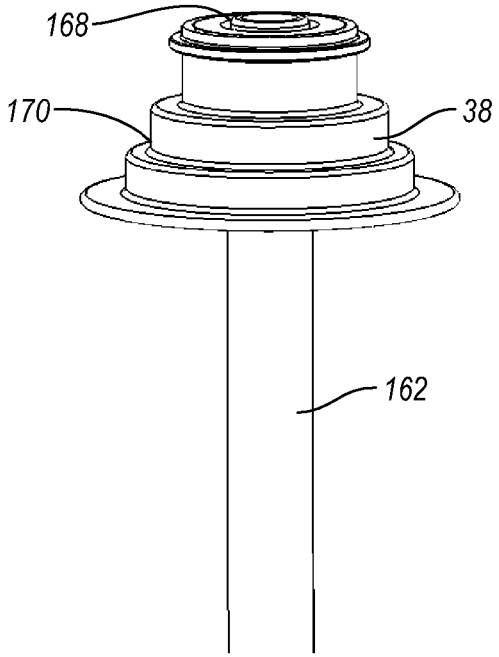
Figure 11:
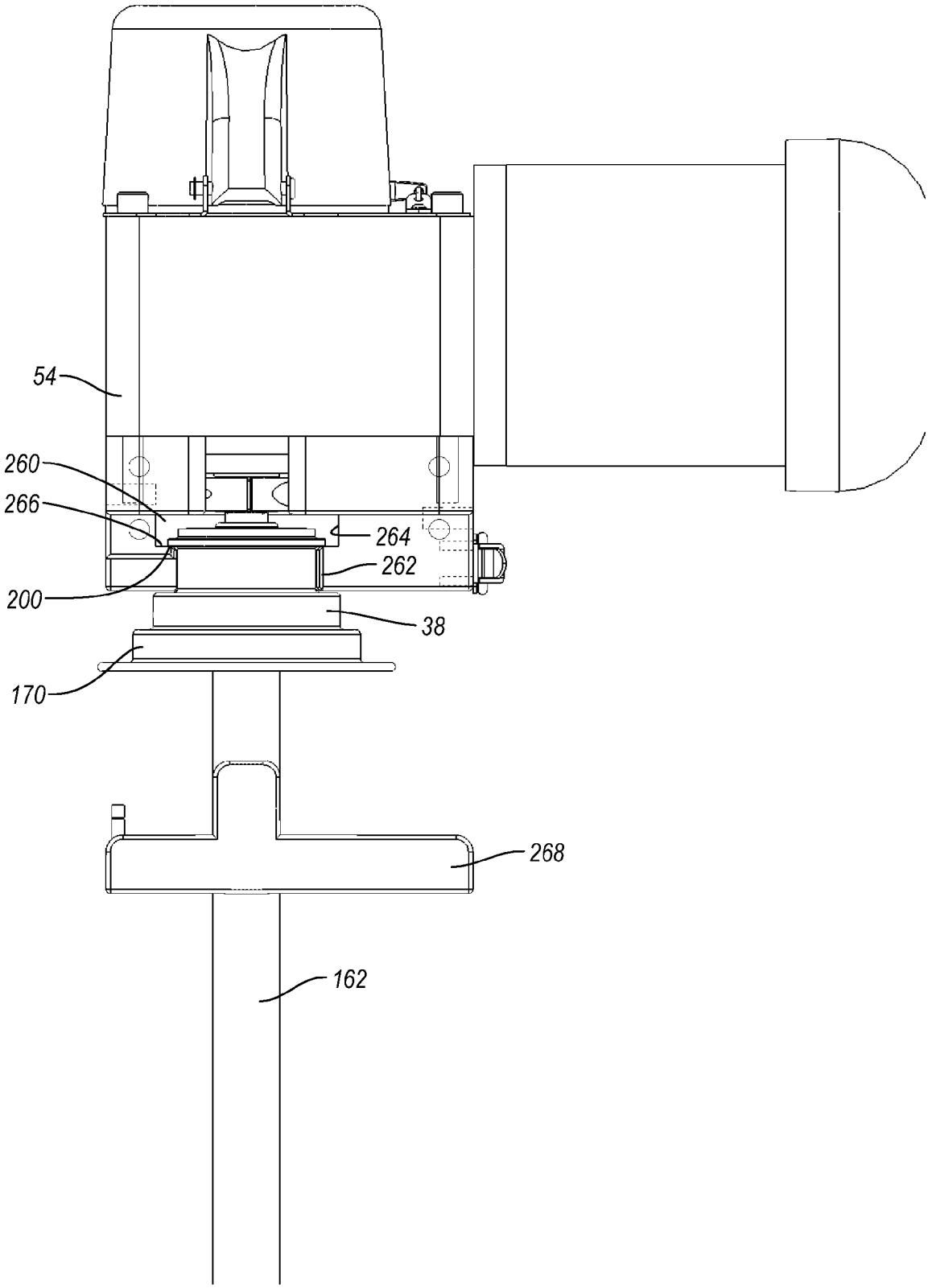
FIG. 11 is a side view of the rotational assembly shown in FIG. 10 coupled with the housing.

During use, container 32 is positioned within chamber 20 of support housing 12. Rotational assembly 38 then connected to housing 54 of mixer 30. Turning to FIG. 10, housing 54 has an open access 260 that is recessed on front face 56 so as to communicate with opening 66 extending through housing 54. Access 260 is in part bounded by a substantially C-shaped first side wall 262 that extends up from bottom surface 60, a concentrically disposed substantially C-shaped second side wall 264 disposed above first side wall 262 and having a diameter larger than first side wall 262, and a substantially C-shaped shoulder 266 extending between side walls 262 and 264. As shown in FIGS. 2A and 11, a door 268 is hingedly mounted to housing 54 and selectively closes the opening to access 260 from front face 56. Door 262 is secured in a closed position by a latch 270. Positioned on first side wall 262 is a section 272 of a resilient and/or elastomeric material such as silicone. Other sections 272 of similar materials can also be positioned on first side wall 262 or the interior surface of door 268.

To facilitate attachment of rotational assembly housing 54, with door 268 rotated to an open position, rotational assembly horizontally slid into access 260 from front face 56 of housing 54 so that support flange 200 of rotational assembly 38 rests on shoulder 266 of access 260. Rotational assembly advanced into access 260 so that passage 175 extending through hub 168 of rotational assembly 38 aligns with passage 92 of motor mount 70 (FIG. 4). In this position, door 268 is moved to the closed position and secured in the closed position by latch 270. As door 268 is closed, casing 170 of rotational assembly 38 is biased against the one or more sections 272 of resilient material so as to clamp rotational assembly 38 within access 260 and thereby prevent unwanted rotational movement of casing 170 relative to housing 54.

Once rotational assembly 38 is secured to housing 54, second end 142 of the assembled drive shaft 110 is advanced down through passage 92 of motor mount 70 depicted in FIG. 5. Second end 142 of drive shaft 110 passes down through motor mount 70, through passage 175 of hub 168 of rotational assembly 38, and through passage 232 of connector 162. Finally, terminus 148 of drive shaft 110 is received within socket 250 of impeller 164. Again, because of the complimentary transverse polygonal configurations of socket 250 and terminus 148, drive shaft 110 engages impeller 164 such that rotation of drive shaft 110 facilitates rotation of impeller 164. With terminus 148 received in socket 250, connecting portion 126 of drive shaft 110 is received within connecting portion 186 of hub 168. Again, the complimentary interlocking configurations of connection portion 126 and 186 cause hub 168 to rotate as drive shaft 110 is rotated. Furthermore, because casing 170 is secured to housing 54, hub 168 rotates relative to casing 170 and housing 54 as drive shaft 110 is rotated. It is further noted that connector 162 also rotates concurrently with impeller 164, hub 168 and drive shaft 110.

Figure 12:
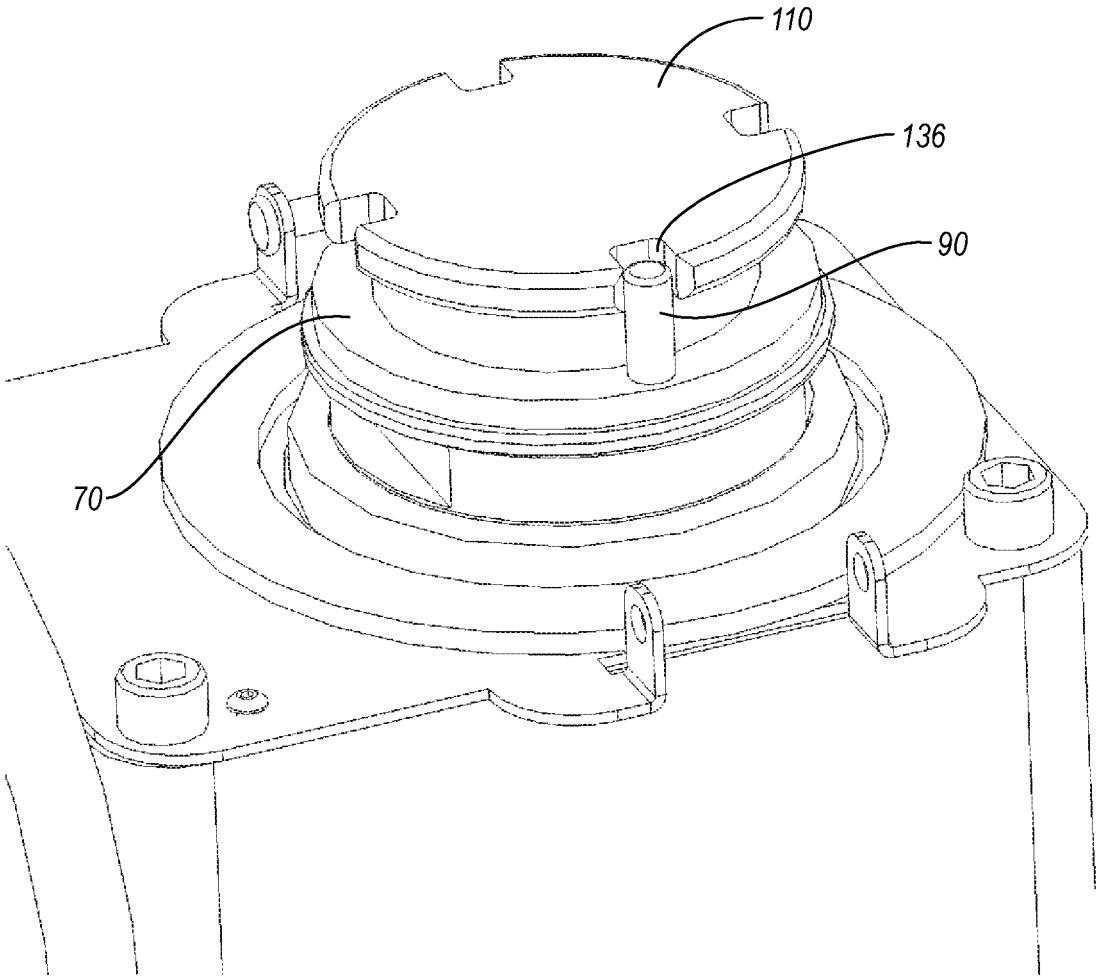
FIG. 12 is a perspective view of the drive shaft being coupled with the motor mount.

Finally, with reference to FIG. 12, once drive shaft 110 is fully passed through motor mount 70, drive shaft 110 is oriented so that locking pin 90 of motor mount 70 is received within a corresponding notch 136 of drive shaft 110. Accordingly, as motor 100 facilitates rotation of motor mount 70, locking pin 90 concurrently rotates with motor mount 70, which in turn biases against the interior surface of notch 136 so as to facilitate rotation of drive shaft 110. In turn, as discussed below in greater detail, rotation of drive shaft 110 facilitates rotation of hub 168, connector 162 and impeller 164. Rotation of impeller 164 facilities mixing of the fluid within compartment 34 of container 32 or compartment 42 of container 40.

Locking pin 90 and notches 136 are only one example of how drive shaft 110 and motor mount 70 can coupled together. It is appreciated that any type of fastener, pin, clamp, keyway or other engaging structure that will couple drive shaft 110 and motor mount 70 together so that rotation of motor mount 70 will rotate draft shaft 100 will work.

Further, with drive shaft 110 received within motor mount 70, frustoconical engaging portion 130 of drive shaft 110 is received within frustoconical engaging portion 96 of motor mount 70. Engaging portions 130 and 96 have complementary configurations so that a close tolerance fit is formed therebetween. The frustoconical configuration of engaging portions 130 and 96 help to facilitate proper centering of drive shaft 110 on motor mount 70. Furthermore, the repeated rotation of drive shaft 110 and impeller 164 produces micro vibrations on drive shaft 110. The close tolerance fit between engagement portions 130 and 96 helps to prevent fret corrosion between drive shaft 110 and motor mount 70.

To further decrease fret corrosion, it is preferable that engaging portions 130 and 96 be formed from different materials. Accordingly, in one embodiment head section 112 of drive shaft 110 is formed from a polymeric material whereas motor mount 70 is formed from metal such as stainless steel, aluminum, or the like. In yet other embodiments, various combinations of different materials can be used.

In one embodiment of the present invention, means are provided for selectively rotating drive shaft 110. One example of such means comprises housing 54, drive motor 100, and motor mount 70 as discussed above. Alternative embodiments of such means comprise the alternatives to drive shaft 100, housing 54, drive motor 100, and motor mount 70 as discussed herein. Further alternatives of such means comprise the alternative systems for rotating the drive shaft as discussed in the '834 application. In still other embodiments, it is appreciated that a variety of other well known keyways, gearing, belt systems, and the like can be used in rotating drive shaft 100.

Returning to FIG. 3, once drive shaft 110 is properly seated on motor mount 70, a retention cap 276 is threaded onto first end 76 of motor mount 70 so as to prevent drive shaft 110 from unintentionally disengaged from motor mount 70. A further safety cap 278 is secured to top surface 58 housing 54 so as to cover retention cap 276 as depicted in FIG. 1.

Once a material is processed and removed from container 32 or 40, the impeller assembly 160 and corresponding containers can be removed and disposed of. A new container and impeller assembly 160 can then be used for the next batch. Since drive shaft 110 and the rest of the mixing system does not contact the processed material, no cleaning or sterilization is required.

As previously discussed, various alternatives for the different components of mixing system 10 and mixer 30 are disclosed in the '834 patent. As such, the various components between the different references can be mixed and matched to obtain a variety of other alternative embodiments.

Returning to FIG. 2B, as previously discussed, in this embodiment mixer 30 operates with container 40 that is an open top liner. That is, in contrast to annular lip 44 of container 40 being sealed to sealing flange 202 of rotational assembly 38, annular lip 44 is freely exposed so as to expose opening 46 to compartment 42. Container 40 can be disposed and supported within support housing 12. The above configuration can be used as a lower cost alternative for mixing non-sterile fluids. In this embodiment, rotational assembly 38 merely functions to secure first end 228 connector 162 to housing 54 so that connector 162 does not unintentionally slide off of drive shaft 110. In alternative embodiments, because rotational assembly 38 is no longer forming a sealed fluid connection between container 40 and connector 162, rotational assembly 38 can be substantially simplified. For example, sealing flange 202 and the various seals 214, depicted in FIG. 8, can be eliminated.

Figure 13:
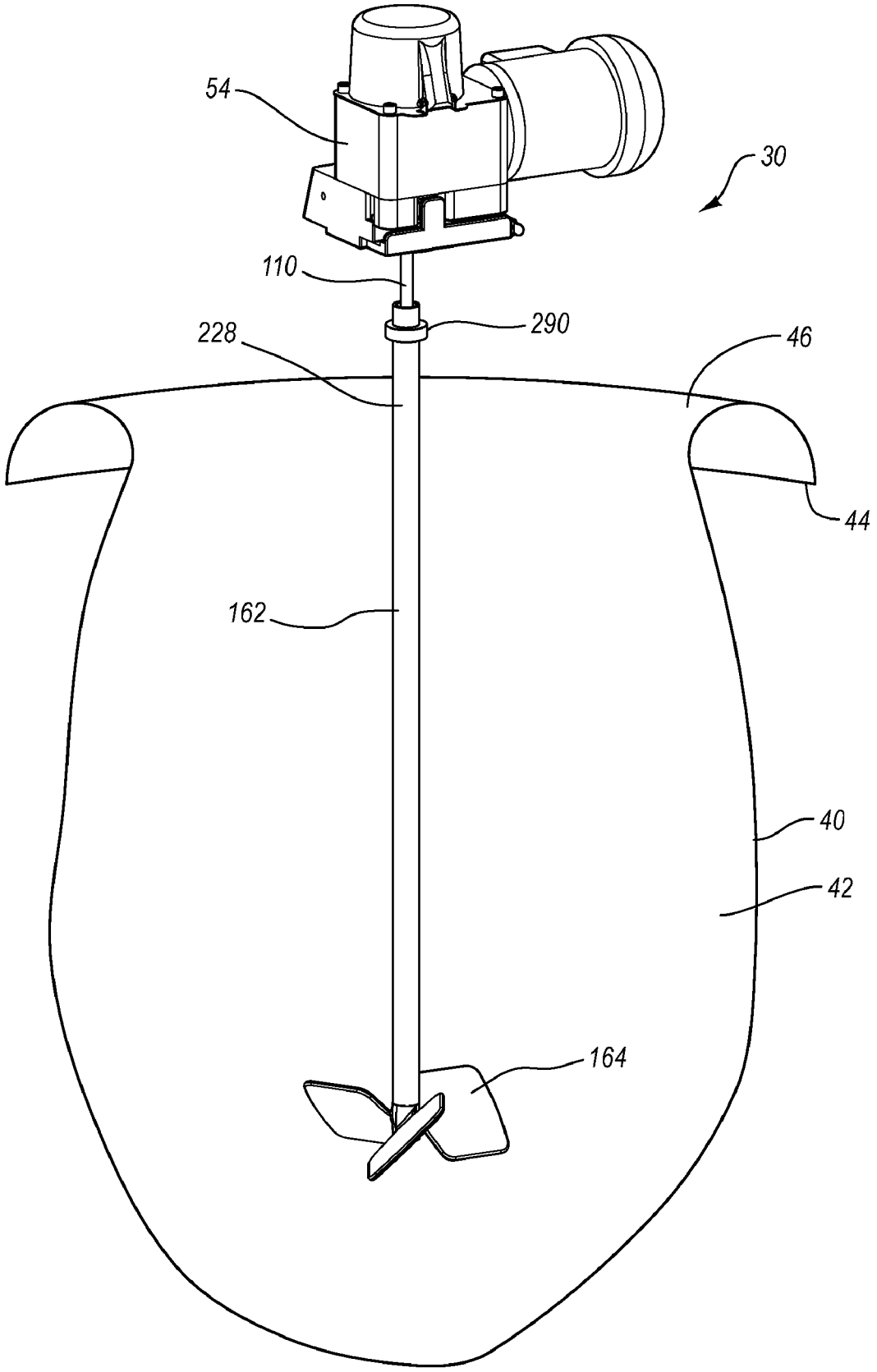
FIG. 13 is a perspective view of an alternative mixer with open container that can be used with the mixing system depicted in FIG. 1.

Depicted in FIG. 13 is a further simplified embodiment of mixer 30. In this embodiment, rotational assembly completely eliminated. A clamp 290 is removably disposed at first end 228 of connector 162 so as to temporarily secure first end 228 of connector 162 to drive shaft 110. That is, clamp 290 can be mounted on tubular connector 162 so as to radially inwardly bias tubular connector 162 directly against drive shaft 110, thereby securing tubular connector 162 to drive shaft 110.

Clamp 290 can come in a variety of alternative configurations. For example, clamp 290 can comprise a conventional mechanical clamp, hose clamp, plastic pull tie, removable crimp, or any other type of fastener that can bias connector 162 to drive shaft 110 to prevent connector 162 and impeller 164 from unintentionally sliding off of drive shaft 110. In one embodiment of the present invention, means are provided for securing first end 228 of tubular connector 162 to drive shaft 110. One example of such means comprise clamp 290 and the alternative embodiments discussed therewith. Once processing and use of a batch is complete, clamp 290 is removed and connector 162 and impeller 164 can be disposed of along with container 40. Replacement parts can then be used for subsequent batches.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A mixing system comprising:

a housing;

a motor mount disposed on the housing and having a passage extending therethrough;

a drive motor coupled with the motor mount for selectively rotating the motor mount relative to the housing; and a rotational assembly comprising a hub having a passageway extending therethrough and a casing at least partially encircling the hub, the hub being rotatable relative to the casing, the rotational assembly being removably coupled to the housing so that the passageway of the hub aligns with the passage of the motor mount.

2. The mixing system as recited in claim 1, further comprising:

an access recessed on the housing, at least a portion of the access being bounded by a shoulder; and the casing of the rotational assembly having a flange formed thereon, the rotational assembly being removably received within the access of the housing so that the flange of the casing rests on the shoulder of the access.

3. The mixing system as recited in claim 2, wherein the housing comprises a door that can be selectively closed so as to clamp the rotational assembly within the access of the housing.

4. The mixing system as recited in claim 3, farther comprising a section of resilient elastomeric material lining a portion of the access, the rotational assembly biasing against the elastomeric material when the door is closed.

5. The mixing system as recited in claim 1, farther comprising:

an elongated tubular connector having a first end and an opposing second end, the first end of the connector being connected to the hub; and an impeller at the second end of the tubular connector 6. The mixing system as recited in claim 5, farther comprising a container having a compartment, the impeller being disposed within the compartment.

7. The mixing system as recited in claim 6, wherein the container comprises a flexible bag secured to the casing of the rotational assembly.

8. The mixing system as recited in claim 6, wherein the container comprises a flexible liner having an open mouth, the connector extending through the open mouth.

9. The mixing system as recited in claim 5, further comprising a drive shaft having a first end and an opposing second end, the second end of the drive shaft being passed through the motor mount, through the hub of the rotational assembly, and through the connector so that the second end of the drive shaft engages with the impeller.

10. The mixing system as recited in claim 9, wherein the first end of the drive shaft engages with the motor mount so that rotation of the motor mount by the drive motor facilitates rotation of the drive shaft.

11. The mixing system as recited in claim 9, further comprising:

the first end of the drive shaft having a first engaging portion with a substantially frustoconical configuration; and the motor mount having an interior surface bounding the passage extending therethrough, a least a portion of the interior surface forming a second engaging portion having a substantially frustoconical configuration complementary to the first engaging portion, the first engaging portion being received within the second engaging portion.

12. The mixing system as recited in claim 11, wherein one of the first engaging portion and the second engaging portion is comprised of a polymeric material and the other of the first engaging portion and the second engaging portion is comprised of a metal.

13. A mixing system comprising:

a motor mount having a passage extending therethrough;

a drive motor coupled with the motor mount for selectively rotating the motor mount;

a container having a compartment; and a drive shaft having a first end and an opposing second end, the first end of the drive shaft having a first engaging portion with a substantially frustoconical configuration, the drive shafted being passed through the passage of the motor mount so that the first engaging portion of the drive shaft is at least partially disposed within the passage of the motor mount and the second end of the drive shaft is disposed within the compartment of the container.

14. The mixing system as recited in claim 13, the motor mount having an interior surface bounding the passage extending therethrough, at least a portion of the interior surface forming a second engaging portion having a substantially frustoconical configuration complementary to the first engaging portion, the first engaging portion being received within the second engaging portion.

15. The mixing system as recited in claim 14, wherein one of the first engaging portion and the second engaging portion is comprised of a polymeric material and the other of the first engaging portion and the second engaging portion is comprised of a metal.

16. The mixing system as recited in claim 13, wherein the drive shaft comprises:

a head section that includes the first engaging portion, the head section being comprised of a polymeric material; and a shaft section that includes the second end of the drive shaft, the shaft section being comprised of a metal, the head section and the shaft section being connected together.

17. The mixing system as recited in claim 13, further comprising:

a housing; and a rotational assembly comprising a hub having a passageway extending therethrough and a casing at least partially encircling the hub, the hub being rotatable relative to the casing, the rotational assembly being removably coupled to the housing so that the passageway of the hub aligns with the passage of the motor mount.

18. The mixing system as recited in claim 17, further comprising:

an access recessed in the housing, at least a portion of the access being bounded by a shoulder; and the casing of the rotational assembly having a flange formed thereon, the rotational assembly being removably received within the access of the housing so that the flange of the casing rests on the shoulder of the access.

19. The mixing system as recited in claim 18, wherein the housing comprises a door that can be selectively closed so as to clamp the rotational assembly within the access of the housing.

20. The mixing system as recited in claim 17, wherein the motor mount is rotatably coupled with the housing.

21. The mixing system as recited in claim 17, further comprising:

an elongated tubular connector having a first end and an opposing second end, the first end of the connector being connected to the hub; and an impeller at the second end of the tubular connector.

22. The mixing system as recited in claim 21, further comprising a container having a compartment, the impeller being disposed within the compartment.

23. The mixing system as recited in claim 22, wherein the container comprises a flexible bag secured to the casing of the rotational assembly.

24. The mixing system as recited in claim 22, wherein the container comprises a flexible liner having an open mouth, the connector extending through the open mouth.

25. The mixing system as recited in claim 21, wherein the second end of the drive shaft is passed through the motor mount, through the hub of the rotational assembly, and through the connector so that the second end of the drive shaft engages with the impeller.

26. The mixing system as recited in claim 25, wherein the first end of the drive shaft engages with the motor mount so that rotation of the motor mount by the drive motor facilitates rotation of the drive shaft.

27. The mixing system as recited in claim 25, wherein the drive shaft engages the hub so that rotation of the drive shaft facilitates rotation of the hub relative to the casing.

28. A mixing system comprising:

an elongated tubular connector having an interior surface bounding a passage extending between a first end and an opposing second end;

an impeller disposed at the second end of the tubular connector;

an elongated drive shaft having a first end and an opposing second end, the second end of the drive shaft being passed through the passage of the tubular connector to engage with the impeller so that rotation of the drive shaft facilitates concurrent rotation of the impeller and tubular connector, the first end of the drive shaft being disposed outside of the passage of the tubular connector;

means for securing the first end of the tubular connector to the drive shaft;

means for selectively rotating the drive shaft.

29. The mixing system as recited in claim 28, wherein the means for securing is mounted on the tubular connector and radially inwardly biases the tubular connector against the drive shaft.

30. The mixing system as recited in claim 28, wherein the means for securing comprises a clamp mounted on the tubular connector.

31. The mixing system as recited in claim 28, further comprising a container having a compartment, the impeller being disposed within the compartment.

32. The mixing system as recited in claim 31, wherein the container comprises a flexible liner having an open mouth, the connector freely extending through the open mouth.

33. The mixing system as recited in claim 32, further comprising a rigid support housing, the liner being at least partially disposed within the rigid support housing.

34. The mixing system as recited in claim 28, wherein the means for selectively rotating the drive shaft.

35. The mixing system as recited in claim 28, wherein the means for selectively rotating the drive shaft comprises:

a housing;

a motor mount disposed on the housing and having a passage extending therethrough; and a drive motor coupled with the motor mount for selectively rotating the motor mount relative to the housing, at least a portion of the drive shaft engaging the motor mount such that rotation of the motor mount facilitates rotation of the drive shaft.

* * * * *

UNITED STATES PATENT AND TRADEMARK OFFICE

CERTIFICATE OF CORRECTION

PATENT NO. : 7,682,067 B2
APPLICATION NO. : 11/379535
DATED : March 23, 2010
INVENTOR(S) : West et al.

It is certified that error appears in the above-identified patent and that said Letters Patent is hereby corrected as shown below:

Drawings

Sheet 9, replace Figure 8 with the figure depicted below, wherein the label "38" has been added

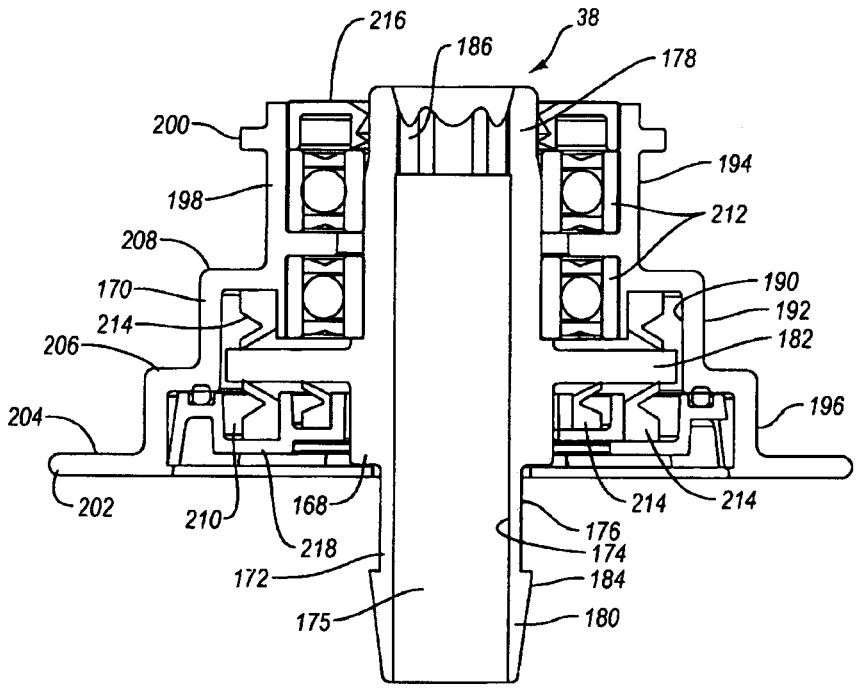

Column 7

Line 34, change "assembly e" to --assembly 38--
Line 51, change "2228" to --228--

Column 8

Line 43, change "Door 262" to --Door 268--

Signed and Sealed this
Fifth Day of July, 2011

David J. Kappos

David J. Kappos
*Director of the United States Patent and Trademark Office*

Column 9

Line 30, change “coupled” to --couple--
Line 34, change “shaft 100” to --shaft 110--
Line 59, change “shaft 100” to --shaft 110--
Line 65, change “shaft 100” to --shaft 110--

Column 10

Line 26, change “connector” to --of connector--
Line 35, change “assembly” to --assembly 38 is--
Line 51, change “comprise” to --comprises--